US005658395A

United States Patent [19]

Wahlberg et al.

[11] Patent Number: 5,658,395

[45] Date of Patent: Aug. 19, 1997

[54] METHOD OF PREPARING POWDERS FOR HARD MATERIALS FROM APT AND SOLUBLE COBALT SALTS

[75] Inventors: Sverker Wahlberg, Hägersten; Mamoun Muhammed, Djursholm; Ingmar Grenthe, Österskär, all of Sweden

[73] Assignee: Sandvik AB, Sandviken, Sweden

[21] Appl. No.: 464,564

[22] Filed: Jun. 5, 1995

[30] Foreign Application Priority Data

Jul. 21, 1994 [SE] Sweden ..... 9402548

[51] Int. Cl.[6] ..... B22F 9/24

[52] U.S. Cl. ..... 148/237; 75/351; 75/361

[58] Field of Search ..... 75/351, 361, 365, 75/369; 148/237

[56] References Cited

U.S. PATENT DOCUMENTS 3,440,035 4/1969 Iwase et al. ..... 75/351

4,765,951 8/1988 Kemp ..... 75/351

4,800,064 1/1989 Kemp et al. ..... 75/365

FOREIGN PATENT DOCUMENTS 91-07244 5/1991 WIPO ..... 75/351

*Primary Examiner*—George Wyszomierski

*Attorney, Agent, or Firm*—Burns, Doane, Swecker & Mathis, L.L.P.

[57] ABSTRACT

According to the present invention there is now provided a method for preparing a powder containing W and Co and/or Ni characterized in reacting APT and a soluble salt of Co (Ni) in water at temperatures from room temperature to the boiling point of the solution keeping the solution pH at a constant level during the chemical reactions. The powder is filtered off, dried and reduced to a metallic powder which may be further carburized to form a powder containing WC and Co and/or Ni.

3 Claims, No Drawings

METHOD OF PREPARING POWDERS FOR HARD MATERIALS FROM APT AND SOLUBLE COBALT SALTS

BACKGROUND OF THE INVENTION

The present invention relates to a method of preparing fine grain WC-Co(Ni)-powders for use in the manufacture of a cemented carbide.

WC-Co-cemented carbides are made by powder metallurgical methods of milling a powder mixture containing powders forming the hard constituents and binder phase, pressing and sintering. The milling operation is an intensive wet milling in mills of different sizes and with the aid of milling bodies which are usually made of cemented carbide. The milling time is of the order of several hours up to days. Milling is believed to be necessary in order to obtain a uniform distribution of the binder phase in the milled mixture. It is further believed that the intensive milling creates a reactivity of the mixture which further promotes the formation of a dense structure.

During the long milling time, the milling bodies are worn and contaminate the milled mixture which has to be compensated for. The milling bodies can also break during milling and remain in the structure of the sintered bodies. Furthermore, even after an extended milling, a random rather than an ideal homogeneous mixture may be obtained. In order to ensure an even distribution of the binder phase in the sintered structure, sintering has to be performed at a higher temperature than necessary.

An alternative way is to start from an intimate mixture of cobalt and tungsten, which mixture subsequently is carburized. U.S. Pat. No. 3,440,035 discloses such a method of preparing cemented carbide powder characterized in that an aqueous solution or suspension of ammoniumparatungstate (APT) and nitric or hydrochloric aqueous solution of, e.g., cobalt, are mixed. The mixture is then subjected to a neutralizing reaction with ammonium hydroxide at a temperature of 20° to 80° C. and the pH-value of the mother solution after the reaction is adjusted to between 4.5 and 8. The resultant fine composite precipitate containing tungsten and cobalt in the desired composition controlled by reaction conditions is filtered, dried by heating and then subjected to reduction and carburization to obtain a WC-Co composite powder in which the WC grain size generally is submicron.

The solution pH is identified in U.S. Pat. No. 3,440,035 as a critical parameter for the control of the precipitation yields and, therefore also, control of the powder composition. The examples, however, indicate large variations in the solution pH leading to variations in the reaction yield and in the product composition. Precise control of composition is essential for the application of the method. The reactions should therefore be stoichiometric (99–100% yield) and/or have reproducible yields. Variations, as in U.S. Pat. No. 3,440,035, make accurate control of the powder composition impossible.

OBJECTS AND SUMMARY OF THE INVENTION

It is an object of this invention to avoid or alleviate the problems of the prior art.

It is another object of this invention to provide a method for producing a fine-grained powder of tungsten and cobalt and/or nickel.

It is a further object of this invention to provide a method for producing a powder mixture of tungsten carbide and/or nickel suited for the production of a cemented carbide.

These and other objects are provided by a method of preparing a powder containing tungsten and cobalt and/or nickel comprising mixing ammoniumparatungstate and a soluble salt of cobalt and/or nickel in water, reacting the mixture at a temperature from ambient to the boiling point of the solution under agitation and a constant pH level to form a precipitate powder of tungsten and cobalt and/or nickel and removing the precipitate from the solution.

DETAILED DESCRIPTION OF THE PREFERRED EMBODIMENTS OF THE INVENTION

The method according to the present invention is characterized by a thorough control of the powder composition and the reaction yields by maintaining the solution pH at a constant level through the whole process.

In the method of the present invention powder ammoniumparatungstate (APT) with the chemical formula $(NH_4)_{10}H_2W_{12}O_{42}\cdot x\cdot H_2O$(x=4–11) is suspended in a water solution of a soluble cobalt (II) salt. The APT particle size should be about 0.1–100 μm, preferably 1–10 μm. The weight/weight ratio of the APT-powder/water solution should be 5–60%, preferably 20–50%, most preferably about 20–30%. The cobalt salt can be cobalt chloride, cobalt nitrate, cobalt acetate or any soluble salt of cobalt. The concentration of cobalt in the solution is chosen to give the desired composition of the final material, taking the yield of the chemical reaction into account. The solution pH is controlled, either by the continuous addition of ammonium hydroxide ($NH_4OH$) during the process, or by the use of a metal salt containing an anion with pH buffering capacity, e.g. cobalt acetate. The suspension is stirred intensively at temperatures from room temperature to the boiling point of the solution. The time to complete reaction depends on the reaction temperature, concentration of ammonium hydroxide, cobalt amount, APT grain size, APT-powder/water ratio etc. As the reaction proceeds, the color of the suspended powder changes from white to pink. A more exact determination of the degree of transformation can be made by conventional powder X-ray diffraction analysis.

The powder is filtered off after the reaction is completed, dried and reduced in a hydrogen atmosphere to a fine homogeneous metallic powder containing intimately mixed Co and W. This mixture may subsequently be carburized at a relatively low temperature of about 1000° C. either by mixing with carbon and heating or heating in a carbon containing gas to a WC-Co-powder with a typically submicron grain size. The powder can be mixed with a pressing agent, compacted and sintered to dense cemented carbide. The initial amounts of APT and cobalt salt are chosen such as to give the desired composition of the WC-Co powder. It has been found that Co-contents of 1–25%, preferably 3–15%. easily can be obtained but compositions outside that range are also possible.

The solution pH has a large effect on the time needed for the conversion of the whim colored APT to the pink cobalt tungstate powder, as well as on the homogeneity of the formed powder. To obtain homogeneous products within a short reaction time, the solution pH should be constantly maintained in a fairly narrow range, pH=8±0.5, during the whole process. This is achieved by the continuous addition of ammonium hydroxide during the process. Comparative Examples 1 and 2 demonstrate the effect of adding the whole amount of ammonium hydroxide from the start. In Comparative Example 1, the concentration of ammonium hydroxide is initially 0.6 mole/kg solution with a pH in the recommended range only in the beginning of the reaction. The obtained product is non-homogeneous in composition. In Comparative Example 2, the initial concentration of ammonium hydroxide is lower, 0.06 mole/kg solution. The effect is a final pH lower than the recommended range, resulting in a long process time.

In an alternative embodiment, the solution pH is controlled by the use of a metal salt containing an anion with pH buffer capacity, e.g. cobalt acetate. No further adjustment of the pH is necessary. The solution pH will be lower, pH=5.5±0.5, than recommended above and longer process times will therefore be required. The yield of the chemical reaction between APT and the cobalt salt is typically 90–100% with respect to tungsten and cobalt. Several parameters such as the solution pH and the W/Co ratio will effect the reaction yield.

The method according to the invention has been described with reference to APT and a cobalt salt, but can also be applied to APT, a cobalt salt and/or a nickel salt. The solvent can be water or water mixed with other solvents, such as ethanol.

The homogeneous fine Co+W-metal powder can also he used in other applications like materials for catalysis or in materials for alloys of high density.

The invention is additionally illustrated in connection with the following Examples which are to be considered as illustrative of the presently claimed invention. It should be understood, however, that the invention is not limited to the specific details of the Examples.

EXAMPLE 1 (Comparative)

790 g cobalt chloride solution (1.69 mole Co/kg solution), 1600 g APT and 3800 g water were charged in a round bottom glass reactor under stirring. 190 g concentrated (25% $NH_3$) ammonium hydroxide solution was added from a dropping funnel during 10 minutes. The suspension was heated up to 80° C. The warming time was 40 minutes and the reaction time after that, 2 hours. The powder was filtered off and dried at 80° C. for 1 day. 4240 g solution, containing 8.5 mmole W/kg and 1.1 mmole Co/kg, was collected. The pH was 8.4. Powder samples were taken for elemental analysis. The powder was inhomogeneous with a molar ratio W/Co varying from 2.4–4.3 in large dark grains to 6.7–7.7 in small pink grains.

EXAMPLE 2 (Comparative)

760 g cobalt chloride solution (1.75 mole Co/kg solution), 1600 g APT, 3930 g water and 19 g concentrated ammonium hydroxide solution (25% $NH_3$), diluted with water to 112 g, were charged in a round bottom glass reactor. The suspension was stirred and heated to 84° C. The powder was filtered off after 8 hours, washed with 500 ml ethanol (99.5%) and dried at 80° C. for 2 days. The dry weight was 1755 g. 3900 g solution, containing 1 mmole W/kg and 3 mmole Co/kg, was collected. The pH was about 6.5. The powder was homogenous in composition containing 65% W and 4.5% Co.

EXAMPLE 3

790 g cobalt chloride solution (1.68 mole Co/kg solution), 1600 g APT and 3800 g water were charged in a round bottom glass reactor. The suspension was stirred and heated up to 80° C. The time for warming to 80° C. was about 50 minutes and the reaction time after that 3 hours. 190 g concentrated ammonium hydroxide solution (25% $NH_3$) was added continuously with a peristaltic pump to maintain the solution pH around 8, starting when the temperature reached 80° C. and ending after 3 hours. The powder was separated by filtration and dried at 80° C. for 2 days. The powder was homogeneous in composition containing 63% W and 4.3% Co.

EXAMPLE 4

140 g cobalt acetate solution (0.58 mole Co/kg solution), 300 g with water and 100 g APT were charged in a round bottom glass reactor. The suspension was stirred and heated until boiling. The powder was filtered off after 7 hours and dried at 60° C. The dry weight was 106 g. 245 g solution, containing 4.8 mmole W/kg and 9.2 mmole Co/kg, was collected. The pH was 5.3. The homogenous powder containing 64.3% W and 4.4% Co was reduced and carburized to a WC-Co powder.

EXAMPLE 5

80 g cobalt nitrate solution (1.7 mole Co/kg solution), 160 g APT, 320 g water and 80 g ethanol were charged in a round bottom glass reactor. The suspension was stirred and heated up to 70° C. The time for warming to 65° C. was about 45 minutes and the reaction time after that 3 hours. 20 g concentrated ammonium hydroxide solution (25% $NH_3$) was added continuously with a peristaltic pump to maintain the solution pH around 8, starting when the temperature reached 65° C. and ending after 3 hours. The powder was separated by filtration and dried at 80° C. for 2 days. The powder was homogenous in composition containing 60% W and 4.5% Co.

The principles, preferred embodiments and modes of operation of the presently claimed invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A method of preparing a powder comprising tungsten and cobalt and optionally nickel, said method comprising mixing ammoniumparatungstate and a soluble salt comprising cobalt acetate and optionally nickel in water to form a suspension thereof, reacting the suspension at a temperature from ambient to the boiling point of the suspension under agitation and at a pH level of 5.5±0.5 to form a precipitate powder of tungsten and cobalt and/or nickel, and removing the precipitate from the suspension, wherein said cobalt acetate keeps the pH level constant during the reacting steps.

2. The method of claim 1, further comprising drying said precipitate and heating it in a reducing atmosphere to form a metallic powder.

3. The method of claim 2, further comprising carburizing said metallic powder to form a powder comprising WC, cobalt and/or nickel.

* * * * *